US007258531B2

(12) United States Patent
Kuhn

(10) Patent No.: US 7,258,531 B2
(45) Date of Patent: Aug. 21, 2007

(54) AXIAL PISTON COMPRESSOR

(75) Inventor: Peter Kuhn, Weinheim (DE)

(73) Assignee: Luk Fahrzeug-Hydraulik GmbH & Co. KG, Bad Homburg V.D.H. (DE)

( * ) Notice: Subject to any disclaimer, the term of this patent is extended or adjusted under 35 U.S.C. 154(b) by 572 days.

(21) Appl. No.: 10/719,730

(22) Filed: Nov. 21, 2003

(65) Prior Publication Data

US 2004/0131476 A1 Jul. 8, 2004

Related U.S. Application Data

(63) Continuation of application No. PCT/DE02/01813, filed on May 21, 2002.

(30) Foreign Application Priority Data

May 23, 2001 (DE) ..... 101 25 264

(51) Int. Cl.
*F04B 1/12* (2006.01)

(52) U.S. Cl. ..... 417/269

(58) Field of Classification Search ..... 417/269; 92/71

See application file for complete search history.

(56) References Cited

U.S. PATENT DOCUMENTS 5,429,482 A * 7/1995 Takenaka et al. ..... 417/269
5,626,463 A * 5/1997 Kimura et al. ..... 417/269
5,765,996 A 6/1998 Fujii et al. ..... 417/269
5,897,298 A * 4/1999 Umemura ..... 417/222.2
6,056,517 A 5/2000 Obrist et al. ..... 417/319
6,092,996 A 7/2000 Obrist et al. ..... 417/269
6,213,733 B1 4/2001 Obrist et al. ..... 417/319
6,250,204 B1 6/2001 Kuhn et al. ..... 92/12.2
6,532,859 B1 3/2003 Kuhn et al. ..... 92/71

FOREIGN PATENT DOCUMENTS

DE 198079747 11/1998
DE 10006508 8/2000
EP 0852294 7/1998

OTHER PUBLICATIONS

Abstract of JP 200240565 A.

* cited by examiner

*Primary Examiner*—Charles Freay
(74) *Attorney, Agent, or Firm*—Davidson, Davidson & Kappel, LLC

(57) ABSTRACT

A compressor, in particular an axial piston compressor having an axial piston drive mechanism for the intake and compression of a coolant, has a drive shaft for the drive mechanism with radial bearings of the shaft located at the front and at the rear of the compressor housing. A drive side having a pulley is defined as the front of the compressor, and the compressor includes at least one axial bearing for the shaft, the axial bearing being located in the cylinder head or pressure cover at the rear.

21 Claims, 1 Drawing Sheet

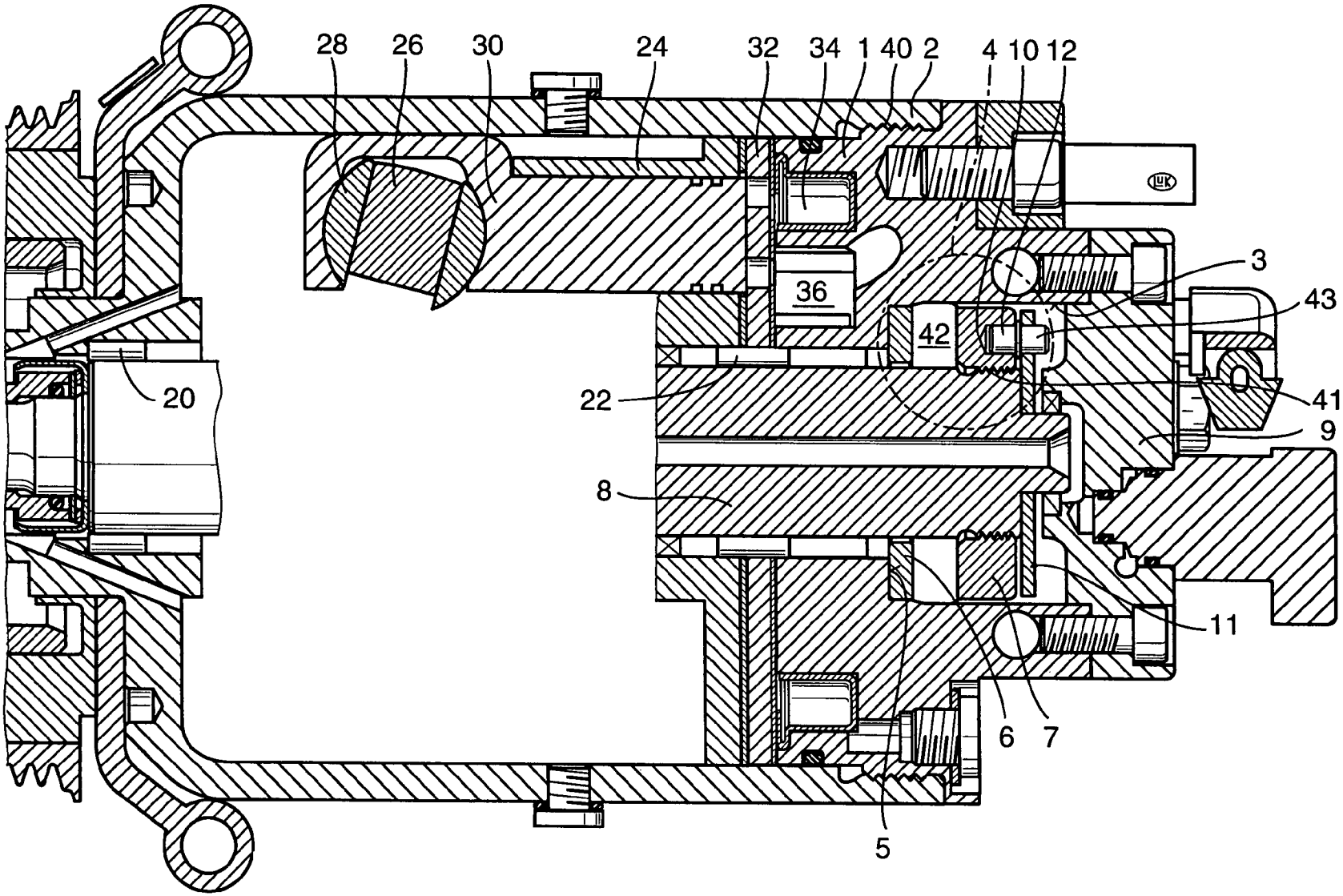
43
41
9
3
11
12
10
4
7
6
2
40
1
34
32
42
36
5
24
22
8
30
26
28
20

AXIAL PISTON COMPRESSOR

CROSS-REFERENCE TO RELATED APPLICATIONS

This is a continuation of International Patent Application No. PCT/DE02/01813, filed May 21, 2002 and claims priority to German Patent Application No. 101 25 264.1 filed May 23, 2001, both applications hereby being incorporated by reference herein.

BACKGROUND INFORMATION

The present invention relates to a compressor, in particular an axial piston compressor having an axial piston drive mechanism for aspirating and compressing a coolant, having a drive shaft for the drive mechanism, having radial bearings of the shaft located at the front and rear of the compressor housing, the drive side having the pulley being defined as the "front," and having at least one axial bearing for the shaft, this axial bearing being located in the rear housing section of the compressor.

Compressors of this type are known, for example, from German Patent Application 19807947 A1. Compared to older designs, this compressor has the advantage that an axial bearing transfers the tensile forces acting in the shaft to a cylinder block, and for that reason, the first housing section remains substantially free from pulsation forces. However, a second housing section, which may also be described as a cylinder head, and a valve plate are still affected by the pulsating pressure forces produced by the compressor work, it being necessary for these forces to be absorbed via a connection between housing section and the second housing section, namely the cylinder block, and routed to the axial bearing via a clamping shoulder of the cylinder block This means that in this design, cylinder head is still available as a sound emitting surface for the sound produced by the pulsating forces.

BRIEF SUMMARY OF THE INVENTION

An object of the present invention is to devise a compressor that does not have these disadvantages.

The object may be achieved by a compressor, in particular an axial piston compressor having an axial piston drive mechanism for aspirating and compressing a coolant, having a drive shaft for the drive mechanism, having radial bearings of the shaft located at the front and rear of the compressor housing, and having at least one axial bearing, i.e. thrust bearing, for the shaft, this axial bearing being located in the rear housing section in the cylinder head or pressure cover of the compressor.

A preferred compressor is characterized in that the axial bearing is positioned in such a way that the forces exerted by the cylinders and by the high pressure in the discharge pressure area on the valve plate and on the cylinder head or pressure cover in axial direction are only transferred by the cylinder head or pressure cover to the axial bearing and all remaining housing areas such as, for example, the external area of the cylinder head, i.e., pressure cover, and all other housing parts and their connecting elements remain free from axial dynamic stresses which are produced by the pulsation of the compressor work.

Another compressor according to the present invention is characterized in that the axial bearing is positioned in such a way that axial tensile forces press the cylinder head, i.e., the pressure cover, against the valve plate and the cylinder block via the axial bearing.

In a compressor according to the present invention, the axial bearing is positioned in such a way that it is still accessible from the outside even after the drive mechanism has been assembled.

In addition, a compressor is preferred in which the axial bearing is positioned in an essentially cylindrical recess in the pressure cover, i.e., cylinder head.

Likewise a compressor is preferred in which the axial position between the axial bearing and shaft is adjustable. According to the present invention, the axial position between the axial bearing and the shaft is used to adjust the shaft or the pivot plate driven by it in relation to the top dead center of the drive mechanism.

In another compressor according to the present invention, the axial bearing may be adjusted by threads between the shaft and a shaft washer, the outer surface of the shaft having external threads and the bore in the shaft washer having internal threads. According to the present invention, the threads between the shaft and the shaft washer have some play.

In addition a compressor is preferred in which the threads make it possible to implement angular adjustability between the shaft and the shaft washer. According to the present invention, the play of the threads makes it possible to compensate for radial deflections of the shaft so that the axial bearing is not influenced and its function is not impaired by this angle error caused by rotating flexures of the shaft during the compressor work. This means that the thread clearance between the shaft and shaft washer compensates for the angle error between the radial deflection of the shaft and the axial bearing.

Another compressor according to the present invention is distinguished in that after adjustment has been made, the threads are secured against turning from the set position, i.e., the set position angle, by a securing device, such as pins or pegs (rivets, bolts, screws, etc.) and recesses (bores, grooves, etc.) or bent tabs of a pressed-on disk.

BRIEF DESCRIPTION OF THE DRAWING

The present invention will now be described with reference to one FIGURE.

DETAILED DESCRIPTION

The following features are explained now in greater detail. An essentially cylindrical recess 3, which is accessible from the outside and which accommodates an axial bearing 4, is located in a pressure cover or cylinder head 1 which is, for example, screwed into a housing 2 using threads 40. Recess 3 terminates at a housing shoulder 5, on which a housing plate 6 of the axial bearing rests. A rotary washer 7 of bearing 4 is attached to the end of a shaft 8. An additional cover 9 covers recess 3 or any similarly designed recess and accordingly axial bearing 4. This placement of axial bearing 4 in pressure cover 1 or at the shaft end located there has the result that axial bearing 4 is still accessible after the essential parts of the compressor are mounted, making it possible to place shaft 8 in an exact axial position as a last assembly step (except for cover 9 of the axial bearing). It is only necessary for the axial forces exerted by the cylinders or by the high pressure in the discharge pressure area on the pressure cover to be transferred through it to the axial bearing. All other housing parts and their connecting elements, in particular threads 40 between the housing and pressure cover, are free from axial dynamic load. Because the housing is thus essentially free from a dynamic load, its sound emission is low.

In contrast, the compressor shown in the related art has the following disadvantages: After the compressor is assembled, it is no longer possible to position the shaft precisely in the axial direction. However, this is desirable to ensure a precise top dead center position of the pistons without having to place excessively high tolerance requirements on the components involved. Maintaining the top dead center position as closely as possible is a prerequisite for good volumetric efficiency (minimal clearance volume) and low friction losses (rapid reduction of the sliding shoe load after top dead center). In still older compressors from the related art in which the axial bearings are situated in front in the pulley area of the housing, the housings are additionally exposed to a high tensile/pulsating stress and the bottom of the housing on which the axial bearing is supported is additionally exposed to a bending load. The dynamic deformations of the housing result in sound emission. The dynamic load on the housing produces a stress on the threads between the housing and the pressure cover in the tensile/pulsating stress range, which is substantially less favorable for the life of the threads than a static tensile load would be.

Another feature of the present invention is the adjustability of the axial bearing. Shaft washer 7 and shaft 8 are connected by threads 41 having some play, the internal threads being located in the bore of shaft washer 7 and the external threads being located on the outer surface of shaft 8. One or a plurality of indentations 10 is located on the face of shaft washer 7 facing away from rolling elements 42. A washer 11 is, for example pressed onto shaft 8. Washer 11 bears a projection 12 that engages an indentation 10 of shaft washer 7. Projection 12 is formed by a peg 43 riveted into washer 11, or projection 12 is formed by a tab (not shown here) bent onto washer 11.

This system has the following advantage: Because the plane of the angle error rotates with shaft 8, dynamic adjustment movements may be avoided if the angular adjustability between shaft 8 and shaft washer 7 is implemented. Because the normals to a thread flank intersect in a relatively narrow range, a thread permits a certain angular adjustability, primarily as a function of the thread clearance and the length of the thread. A thread between shaft 8 and shaft washer 7 thus compensates for the angle error and may be used at the same time for the axial positioning of shaft 8. It need not and must not be clamped. It must merely be secured against further turning after shaft 8 has been axially positioned. According to the present invention, a washer 11 additionally pressed onto the shaft after positioning and which positively engages shaft washer 7 with respect to turning, is used for this purpose.

The reason for locating axial bearing 4 in pressure cover 1 or at the shaft end is in part to make an exact, axial positioning of shaft 8 possible after the major parts of the compressor have been assembled. Shims in combination with other engaging members such as retainer rings, shaft shoulders, slotted nuts or end plates on the end of a shaft are customarily used for this purpose. However, because radial bearings 20, 22 of the compressor are subject to loads in different directions, an angle error is produced for shaft 8 due to their play and their springing. Because axial bearings are sensitive to angle errors in particular, a possibility for adjustment must be created.

The following description elucidates the general function of the compressor. Shaft 8 which is driven for example by a pulley or the like in a motor vehicle, is supported on a radial bearing 20 in housing section 2 and on another radial bearing 22 both in cylinder head 1 as well as by passing through a valve plate 32 in a cylinder block 24, radial bearing 22 also being used to center the components just named. Via a driving device not described in greater detail here, shaft 8 drives pivot plate 26, which sets a plurality of pistons into back and forth motion via sliding shoes 28.

Through their back and forth motion in cylinder block 24, pistons 30 in turn produce suction and compression operations in alternation for a pressurized medium such as the gas of an air conditioning system, the gas being aspirated from a suction side 36 through valve plate 32 and then discharged via valve plate 32 into a high pressure side 34. To that end, intake and discharge valves in the form of spring tongues, which are not shown in detail here, are situated on valve plate 32. Such valve devices are known and need not be described further here. It is essential to the invention that primarily in high pressure zone 34, the pulsating discharge of the pressurized medium produces pulsating forces, i.e., ascending and descending pressure forces, which normally tend to lift cylinder head 1 in the axial direction in relation to housing section 2. However, these pulsating pressure forces are absorbed in the center of cylinder head 1 by axial bearing 4 and shoulder 5 on cylinder head 1 and guided via shaft 8 within the compressor back to pivot plate 26, where the power circuit is then closed within the drive mechanism to include the compression and thus the pulsation of the pressurized medium. This means that even the outer areas of cylinder head 1 are no longer adversely affected by these pulsations, not to mention the transfer of these dynamic forces into housing 2 and thus, over a large surface, to the environment, which would be expressed as a corresponding sound emission.

What is claimed is:

1. A compressor comprising:

a housing having a front and a rear, the compressor being driven via the front;

a cylinder head or pressure cover at the rear of the housing;

a drive shaft for a drive mechanism of the compressor, the drive shaft and drive mechanism being at least partially located in the housing;

radial bearings for the drive shaft being located at the front and rear of the housing;

at least one axial bearing for the drive shaft, the axial bearing being located in the cylinder head or pressure cover; and a valve plate, wherein the axial bearing is positioned so that axial tensile forces in the drive shaft press the cylinder head or pressure cover against the valve plate and the cylinder block via the axial bearing.

2. The compressor as recited in claim 1 wherein the axial bearing is accessible from an outside after assembly of the drive mechanism.

3. The compressor as recited in claim 1 wherein the pressure cover or cylinder head has a cylindrical recess and the axial bearing is positioned in the cylindrical recess.

4. The compressor as recited in claim 1 wherein the axial bearing has an adjustable axial position with respect to the drive shaft.

5. The compressor as recited in claim 4 wherein the axial position between the axial bearing and drive shaft adjusts the drive shaft in relation to a top dead center of the drive mechanism.

6. The compressor as recited in claim 4 further comprising a shaft washer, the axial bearing being adjustable by threads between the shaft and a shaft washer, an outer surface of the drive shaft having external threads and the bore in the shaft washer having internal threads.

7. The compressor as recited in claim 6 wherein the threads between the drive shaft and shaft washer exhibit play.

8. The compressor as recited in claim 7 wherein the threads permit angular adjustability between the drive shaft and the shaft washer.

9. The compressor as recited in claim 7 wherein the play compensates for radial deflections of the drive shaft, a function of the axial bearing not being impaired by the radial deflections.

10. The compressor as recited in claim 6 wherein a thread clearance between the drive shaft and shaft washer compensates for an angle error caused by a radial deflection of the drive shaft and the axial bearing.

11. The compressor as recited in claim 4 wherein after adjustment, the threads are secured against turning from a set angle position by a securing device.

12. The compressor as recited in claim 1 wherein the compressor is an axial piston compressor, and the drive mechanism is an axial piston drive mechanism for aspirating and compressing a coolant.

13. The compressor as recited in claim 1 wherein the drive shaft is driven by a pulley mechanism located outside the housing at the front.

14. A compressor comprising:

a housing having a front and a rear, the compressor being driven via the front;

a cylinder head or pressure cover at the rear of the housing;

a drive shaft for a drive mechanism of the compressor, the drive shaft and drive mechanism being at least partially located in the housing;

radial bearings for the drive shaft being located at the front and rear of the housing;

at least one axial bearing for the drive shaft, the axial bearing being located in the cylinder head or pressure cover; and the axial bearing has an adjustable axial position with respect to the drive shaft.

15. The compressor as recited in claim 14 wherein the axial position between the axial bearing and drive shaft adjusts the drive shaft in relation to a top dead center of the drive mechanism.

16. The compressor as recited in claim 14 further comprising a shaft washer, the axial bearing being adjustable by threads between the shaft and a shaft washer, an outer surface of the drive shaft having external threads and the bore in the shaft washer having internal threads.

17. The compressor as recited in claim 16 wherein the threads between the drive shaft and shaft washer exhibit play.

18. The compressor as recited in claim 17 wherein the threads permit angular adjustability between the drive shaft and the shaft washer.

19. The compressor as recited in claim 17 wherein the play compensates for radial deflections of the drive shaft, a function of the axial bearing not being impaired by the radial deflections.

20. The compressor as recited in claim 16 wherein a thread clearance between the drive shaft and shaft washer compensates for an angle error caused by a radial deflection of the drive shaft and the axial bearing.

21. The compressor as recited in claim 14 wherein after adjustment, the threads are secured against turning from a set angle position by a securing device.

* * * * *